US005400547A

United States Patent [19]

Tanaka et al.

[11] Patent Number: 5,400,547

[45] Date of Patent: Mar. 28, 1995

[54] POLISHING MACHINE AND METHOD OF DISSIPATING HEAT THEREFROM

[75] Inventors: Kohichi Tanaka; Hiromasa Hashimoto; Fumio Suzuki, all of Fukushima, Japan

[73] Assignee: Shin-Etsu Handotai Co., Ltd., Tokyo, Japan

[21] Appl. No.: 22,478

[22] Filed: Feb. 25, 1993

[30] Foreign Application Priority Data

Feb. 28, 1992 [JP] Japan ..... 4-078290

[51] Int. Cl.[6] ..... B24B 7/22; B24B 55/02

[52] U.S. Cl. ..... 451/287; 451/548; 451/488

[58] Field of Search ..... 51/356, 322, 283 R, 51/131.1, 267, 209 R, 209 DL

[56] References Cited

U.S. PATENT DOCUMENTS 4,471,579 9/1984 Bovensiepen ..... 51/322
5,022,191 6/1991 Broido ..... 51/209 DL
5,076,024 12/1991 Akagawa et al. ..... 51/209 DL

FOREIGN PATENT DOCUMENTS 3411120 11/1984 Germany ..... 51/356
0217062 10/1985 Japan ..... 51/131.4

*Primary Examiner*—Robert A. Rose
*Attorney, Agent, or Firm*—Ronald R. Snider

[57] ABSTRACT

A polishing machine for polishing a flat workpiece such as a semiconductor wafer has a rotatable reference table supporting an abrasive cloth disposed on a surface thereof, and a rotatable workpiece holder for holding a flat workpiece against the abrasive cloth. While the flat workpiece is being polished by the abrasive cloth, an abrasive compound is supplied between the abrasive cloth and the flat workpiece. The reference table has grooves defined therein for dissipating heat from the reference table and the abrasive cloth while the flat workpiece is being polished by the abrasive cloth. The grooves may be supplied with either the abrasive compound or a coolant.

23 Claims, 14 Drawing Sheets

POLISHING MACHINE AND METHOD OF DISSIPATING HEAT THEREFROM

BACKGROUND OF THE INVENTION

1. Field of the Invention

The present invention relates to a polishing machine for a surface of a flat workpiece such as a semiconductor wafer of silicon single crystal, and a method of dissipating heat from such a polishing machine.

2. Description of the Prior Art

Recent years have seen semiconductor devices that are fabicated into high-density integrated circuits by the ever-advancing technology of defining intricate patterns in microscopic scale on simiconductor wafer surfaces. Designs on semiconductor devices that are available today have a line width ranging from 1 μm to 0.5 μm or even smaller.

Unless semiconductor wafers which serve as substrates of such semiconductor devices have flat surfaces, they cannot be processed highly accurately by various semiconductor microcircuit fabrication processes including lithography, etching, and thin-film deposition. Naturally, as the interconnections to be formed on semiconductor wafers are required to be narrower, the semiconductor wafers should have flatter surfaces. Therefore, polishing processes and polishing machines for polishing semiconductor wafers to a flat finish are also required to be improved at all times.

FIG. 24 of the accompanying drawings schematically shows a conventional polishing machine for polishing a semiconductor wafer.

As shown in FIG. 24 the polishing machine has a disc-shaped reference table 55 with a flat upper surface which is supported on a reference table holder 56. The reference table holder 56 has an integral shaft 57 coupled to a rotary actuator (not shown) for rotating the reference table holder 56. The flat upper surface of the reference table 55 is substantially fully covered with an abrasive cloth 58. A wafer holder head 8 with a semiconductor wafer 7 held against its lower surface can be rotated about its own axis by another rotary actuator (not shown). The polishing machine also has an abrasive compound supply unit 59 for supplying an abrasive compound 9 to a position between the semiconductor wafer 7 and the abrasive cloth 58. The abrasive compound 9 may comprise, for example, a fluid dispersion that is composed of an abrasive grain such as colloidal silica distributed in an alkaline solution.

The reference table holder 56 has an upwardly opening coolant reservoir 60 defined in its upper surface and closed by the lower surface of the reference table 55. The shaft 57 has a coolant supply passage 61 and a coolant discharge passage 62 which are defined therein in communication with the coolant reservoir 60. The coolant supply passage 61 and the coolant discharge passage 62 are connected to a cooler 63 and a coolant supply 64. The coolant supply 64 supplies a coolant to the cooler 63 which cools the coolant. The coolant cooled by the cooler 63 is supplied through the coolant supply passage 61 into the coolant reservoir 60. After having cooled the reference table 55, the coolant is discharged from the coolant reservoir 60 through the coolant discharge passage 62 back to the coolant supply 64 so that the coolant will be used in circulation.

To polish the semiconductor wafer 7 highly flatwise, it is necessary for the reference table 55 including the abrasive cloth 58 to have a flat surface that is pressed against the semiconductor wafer 7 during the polishing process, and also to be free from abrasive wear and deformation due to mechanical stresses.

To meet the above requirements, the reference table 55 is made of a material and has a structure such that the reference table 55 has a desired mechanical strength. If the semiconductor wafer 7 has a relatively large diameter, or the polishing machine is relatively large in size or operates at relatively high speed to increase its ability to polish the semiconductor wafer 7 for higher productivity, then the reference table 55 tends to be deformed by a localized temperature irregularity thereof due to a friction-induced heat generated in a local region where the semiconductor wafer 7 is in abrasive contact with the reference table 55. Such a deformation will prevent the semiconductor wafer 7 from being polished to a desired degree of flatness. To polish the semiconductor wafer 7 highly efficiently, it is necessary that the semiconductor wafer 7 be polished at high speed while being pressed against the reference table 55 under strong forces. However, such a high-speed, high-pressure polishing process results in an increase in the temperature of the semiconductor wafer 7 and the abrasive cloth 58, increasing the localized temperature irregularity of the reference table 55.

To achieve a desired degree of flatness of the semiconductor wafer 7, the semiconductor wafer 7 and the abrasive cloth 58 be held in uniform contact with each other. More specifically, during the polishing process, the friction-induced heat is generated between the semiconductor wafer 7 and the abrasive cloth 58, heating them to a higher temperature. Unless the contacting surfaces of the semiconductor wafer 7 and the abrasive cloth 58 were kept at a uniform temperature, it would not be possible to polish the semiconductor wafer 7 to a uniform surface finish.

The polishing capability of the abrasive compound 9 also depends on the temperature thereof. If the temperature of the abrasive compound 9 present between the semiconductor wafer 7 and the abrasive cloth 58 becomes irregular, the abrasive compound 9 can no longer polish the semiconductor wafer 7 to a uniform surface finish.

The coolant reservoir 60 serves to cool the reference table 55 to prevent the semiconductor wafer 7 and the abrasive cloth 58 from being unduly heated. FIG. 25 of the accompanying drawings shows a temperature distribution across the reference table 55 and the reference table holder 56. As shown in FIG. 25, the region where the reference table 55 and the semiconductor wafer 7 are held in abrasive contact with each other has a relatively large flow of frictional-heat energy directed downwardly as indicated by the arrow A, and a relatively small flow of frictional-heat energy directed downwardly as indicated by the arrow B near the circumferential edge of the reference table 55. The same abrasive-contact region also has an upward flow of heat energy, as indicated by the arrow C, from the rotary actuator which rotates the shaft 57 of the reference table holder 56. As a result, as shown on the lefthand side of FIG. 25, the abrasive-contact region on the reference table 55 contains an area that undergoes relatively high frictional heat as indicated by the solid line and an area which undergoes relatively low frictional heat as indicated by the dotted line.

Since the reference table 55 usually has a thickness of several tens millimeters, only the coolant reservoir 60 cannot sufficiently cool the frictional face side of the reference table 55. As a consequece, the temperatures of the face and reverse sides of the reference table 55 differ widely from each other, causing the reference table 55 to be largely deformed as shown in FIG. 26 of the accompanying drawings. The reference table 55 is normally made of SUS or a ceramic material, whereas the reference table holder 56 of cast iron. The reference table 55 is therefore also deformed due to different coefficients of thermal expansion of the reference table 55 and the reference table holder 56. For the above reasons, the reference table 55 cannot keep its face side as flat as desired for uniformly polishing the semiconductor wafer 7.

FIG. 28 of the accompanying drawings shows a process of polishing one semiconductor wafer 7 at a time with the abrasive cloth 58, and FIG. 29 of the accompanying drawings shows a process of polishing a batch of four semiconductor wafers 7 supported on a single wafer plate 65 with the abrasive cloth 58. In either of the illustrated processes, the heat generated in the region where the reference table 55 is in sbrasive contact with the semiconductor wafer or wafers 7 is responsible for a temperature irregularity on the surface of the reference table 55, and the abrasive cloth 58 imposes an abrasive load on the semiconductor wafer or wafers 7 in that region due to the abrasive action of the abrasive cloth 58 on the semiconductor wafer or wafers 7 during rotation of the abrasive cloth 58. In FIGS. 28 and 29, as the curve goes higher, the abrasive load is higher and so is the frictional head. Therefore, as shown in FIG. 27 of the accompanying drawings, the center of each semiconductor wafer 7 is higher in temperature than the circumferential area thereof, resulting in an irregular temperature distribution in each semiconductor wafer 7. Irrespective of whether one semiconductor wafer is polished at a time or a batch of semicondutor wafers 7 are polished simultaneously, it has been impossible to finish the semiconductor wafer or wafers 7 to a desired flat finish.

SUMMATY OF THE INVENTION

It is an object of the present invention to provide a polishing machine for polishing a flat workpiece to a desired degree of flatness while cooling an abrasive cloth and a reference table for minimizing temperature irregularities and thermally induced deformations of the reference table, so that the flat workpiece can be polished under high pressure at high speed.

Another object of the present invention is to provide a method of dissipating heat from a polishing machine for polishing a flat workpiece.

According to the present invention, there is provided a polishing machine for polishing a flat workpiece, comprising a rotatable reference table supporting an abrasive cloth disposed on a surface thereof, a rotatable workpiece holder for holding a flat workpiece against said abrasive cloth, and means for supplying an abrasive compound between said abrasive cloth and the flat workpiece, said reference table having groove means defined therein for dissipating heat from said reference table and said abrasive cloth while the flat workpiece is being polished by said abrasive cloth.

According to the present invention, there is also provided a polishing machine for polishing a flat workpiece, comprising a plurality of rotatable reference table blocks each supporting an abrasive cloth disposed on a surface thereof, a rotatable workpiece holder for holding a flat workpiece against said abrasive cloth, and means for supplying an abrasive compound between said abrasive cloth and the flat workpiece, said reference table blocks defining a plurality of grooves therebetween for dissipating heat from said reference table blocks and said abrasive cloth while the flat workpiece is being polished by said abrasive cloth.

According to the present invention, there is further provided a method of dissipating heat from a polishing machine for polishing a flat workpiece with an abrasive cloth disposed on a reference table having grooves while pressing the flat workpiece against the abrasive cloth and supplying an abrasive compound between the flat workpiece and the abrasive cloth, said method comprising the steps of supplying the abrasive compound into said grooves, and discharging the abrasive compound from said grooves.

According to the present invention, there is also provided a method of dissipating heat from a polishing machine for polishing a flat workpiece with an abrasive cloth disposed on a reference table having grooves while pressing the flat workpiece against the abrasive cloth and supplying an abrasive compound between the flat workpiece and the abrasive cloth, said method comprising the steps of supplying a coolant said grooves, and discharging the coolant from said grooves.

The above and other objects, features, and advantages of the present invention will become apparent from the following description when taken in conjunction with the accompaning drawings which illustrate preferred embodiments of the present invention by way of example.

DETAILED DESCRIPTION OF THE PREFERRED EMBODIMENTS

Figure 1:
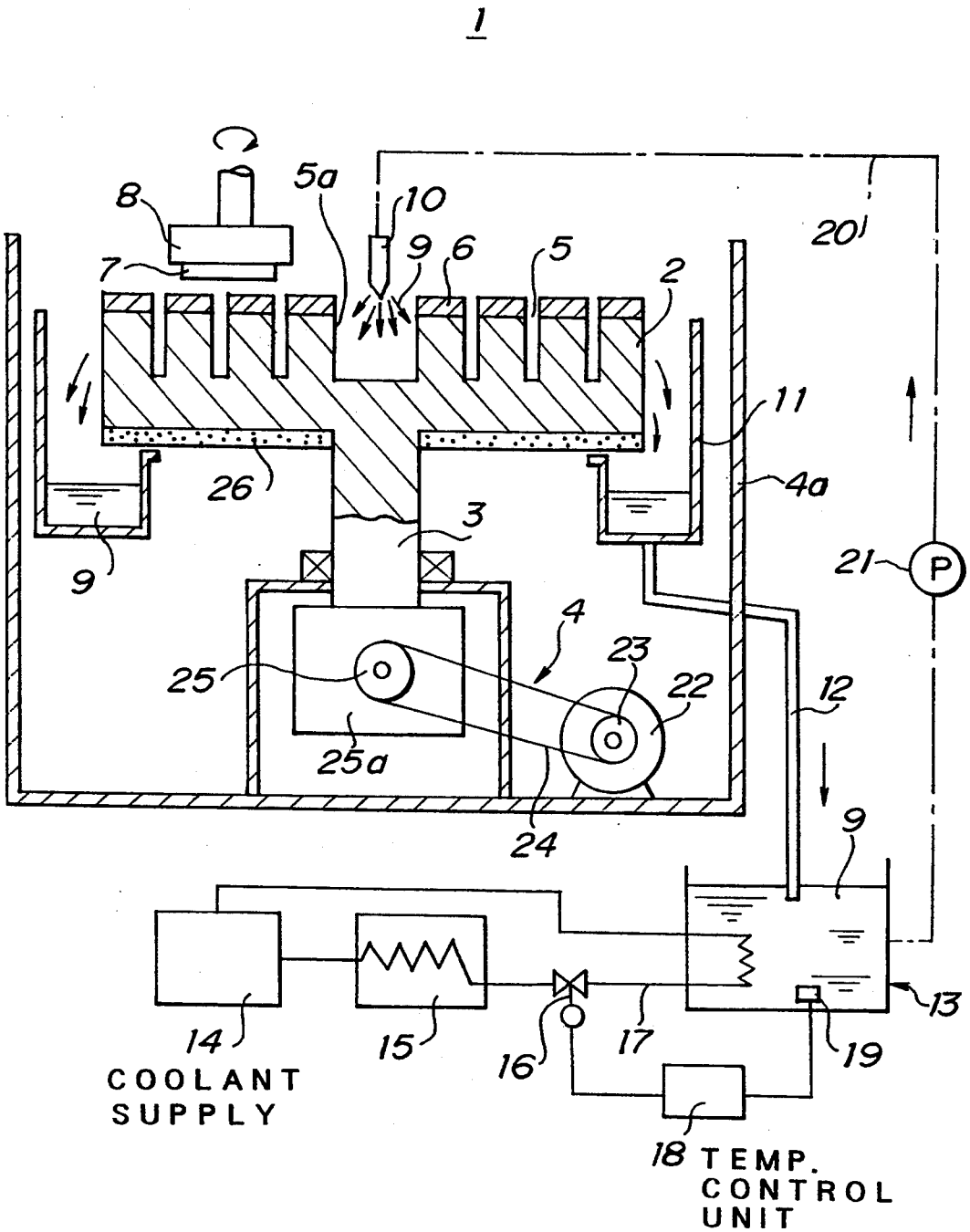
FIG. 1 is an axial cross-sectional view, partly in a coolant circuit diagram, of a polishing machine according to an embodiment of the present invention.

As shown in FIG. 1 a polishing machine 1 to which the principles of the present invention are applied includes a circular reference table 2 having a flat upper surface and an integral central shaft 3 operatively coupled to a drive unit 4. The reference table 2 has a plurality of grooves 5 (described later on) defined in its flat upper surface and held in communication with a central circular recess 5*a* defined in the reference table 2. The grooves 5 extend from the upper surface of the reference table 2 toward the back thereof, but terminate short of the back of the reference table 2. The upper surface of the reference table 2 is covered with an abrasive cloth 6 that also has a plurality of grooves defined in registry with the grooves 5 in the reference table 2. A wafer holder head 8 with a semiconductor wafer 7 held against its lower surface is positioned such that the semiconductor wafer 7 faces toward the abrasive cloth 6. The wafer holder head 8 can be rotated about its own axis by a rotary actuator (not shown).

The polishing machine also has an abrasive compound supply nozzle 10 for supplying an abrasive compound 9 to a position between the semiconductor wafer 7 and the abrasive cloth 6. The abrasive compound 9 is used to both polish and cool the semiconductor wafer 7. An annular abrasive compound receiver 11 is attached to the reference table 2 around its outer circumferential edge for receiving the abrasive compound 9 that flows radially outwardly on the reference table 2 and falls off the outer circumferential edge thereof.

An abrasive compound discharge pipe 12 has an upper end connected to the abrasive compound receiver 11 and a lower end opening into an abrasive compound tank 13. Therefore, the abrasive compound that flows off the reference table 2 returns through the abrasive compound receiver 11 and the abrasive compound discharge pipe 12 back to the abrasive compound tank 13.

A coolant pipe 17, which has one end connected through a cooler 15 and a control valve 16 to a coolant supply 14, has a portion extending through the abrasive compound tank 13. The other end of the coolant pipe 17 is connected also to the coolant supply 14. A temperature control unit 18 is electrically connected to a temperature sensor 19 in the abrasive compound tank 13 and the control valve 16. In response to a detected temperature signal from the temperature sensor 19, the temperature control unit 18 opens or closes the control valve 16 to control the flow of a coolant in the coolant pipe 17 for keeping the abrasive compound 19 at a predetermined temperature in the abrasive compound tank 13. An abrasive compound supply pipe 20 with a pump 21 has one end connected to the abrasive compound tank 13 and the other end to the abrasive compound supply nozzle 10.

The drive unit 4 comprises a drive motor 22 mounted on a bottom panel of a container 4*a* which houses the reference table 2 and the abrasive compound receiver 11, a pulley 23 mounted on the output shaft of the drive motor 22, a pulley 25 coupled through a transmission mechanism 25*a* to the shaft 3, and an endless belt 24 trained around the pulleys 23, 25. The rotational power from the drive motor 22 can thus be transmitted through the pulley 23, the endless belt 24, the pulley 25, and the transmission mechanism 25*a* to the shaft 3 for thereby rotating the reference table 2.

The reference table 2 has its back or lower surface covered with a thermally insulating layer 26 which faces downwardly toward the drive unit 4. The abrasive compound receiver 11 has an inner edge joined to the thermally insulating layer 26.

The polishing machine operates as follows:

The abrasive compound 9 that has been cooled to a suitable temperature by the coolant supplied from the coolant supply 14 is delivered by the pump 21 from the abrasive compound tank 13 through the abrasive compound supply pipe 20 to the abrasive compound supply nozzle 10, from which the abrasive compound 9 is ejected onto the upper surface of the abrasive cloth 6 and also into the central recess 5*a*. The ejected abrasive compound 9 flows between the semiconductor wafer 7 and the abrasive cloth 6, and also passes from the central recess 5*a* into the grooves 5 in the reference table 2. The abrasive compound 9 which flows through the grooves 5 cools the reference table 2 substantially in its entirety, and then falls off the circumferential edge of the reference table 2 into the abrasive compound receiver 11, from which the abrasive compound flows through the abrasive compound discharge pipe 12 into the abrasive compound tank 13 for circulation.

In the abrasive compound tank 13, the abrasive compound 9 is cooled by the coolant flowing through the coolant pipe 17, and is kept at a substantially constant temperature by the control valve 16 which is selectively opened and closed by the temperature control unit 18 in response to a detected temperature signal from the temperature sensor 19.

During a polishing process, the reference table 2 is rotated by the drive unit 4, and at the same time the wafer holder head 8 is also rotated by its rotary actuator. Therefore, the semiconductor wafer 7 supported by the wafer holder head 8 is polished to a flat finish while in pressed sliding contact with the abrasive cloth 6.

Figure 2:
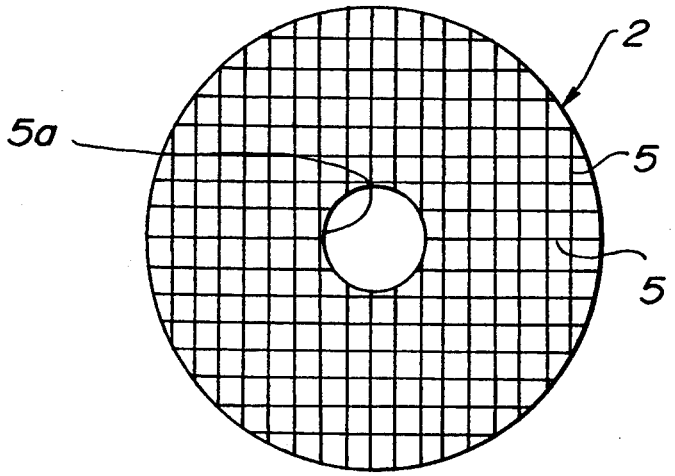
FIG. 2 is a plan view of a reference table of the polishing machine shown in FIG. 1 the reference table having grooves.

As shown in FIG. 2, the grooves 5 in the reference table 2 are arranged in a grid pattern, i.e., in parallel rows and columns that extend perpendicularly to each other in criss-cross relationship.

Figure 3:
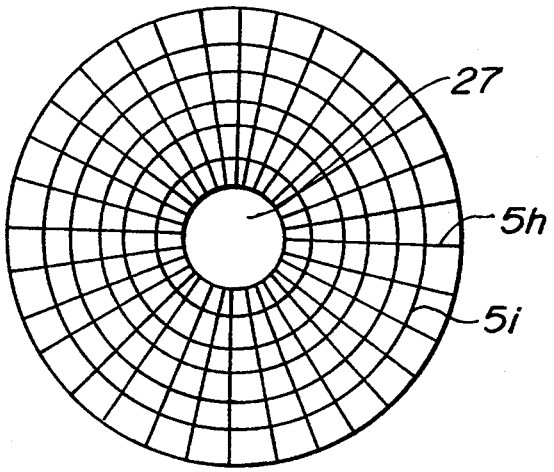
FIG. 3 is a plan view of a modified reference table that can be used in the polishing machine shown in FIG. 1, the modified reference table haveng grooves.

FIG. 3 shows in plan a modified reference table that can be used in the polishing machine shown in FIG. 1 The modified reference table has a central circular recess 27 and a plurality of radial straight grooves **5*h* defined in its upper surface and extending radially outwardly from the central recess 27 and a plurality of circular grooves 5*i* defined in its upper surface and extending concentrically with the central recess 27 in crossing relationship to the radial straight grooves 5*h***.

In FIG. 3, the recess 27 may be positioned offcenter with respect to the reference table, and the radial straight grooves **5*h* may extend radially out wardly from the eccentric recess 27 and the circular grooves 5*i* may extend concentrically with the eccentric recess 27**.

Alternatively, a reference table may have concentric grooves and radial arcuate grooves crossing the concentric grooves. At any rate, the grooves 5 may be shaped and sized depending on the temperature distribution in the reference table 2 and the abrasive cloth 6 for cooling them effectively.

Figure 4:
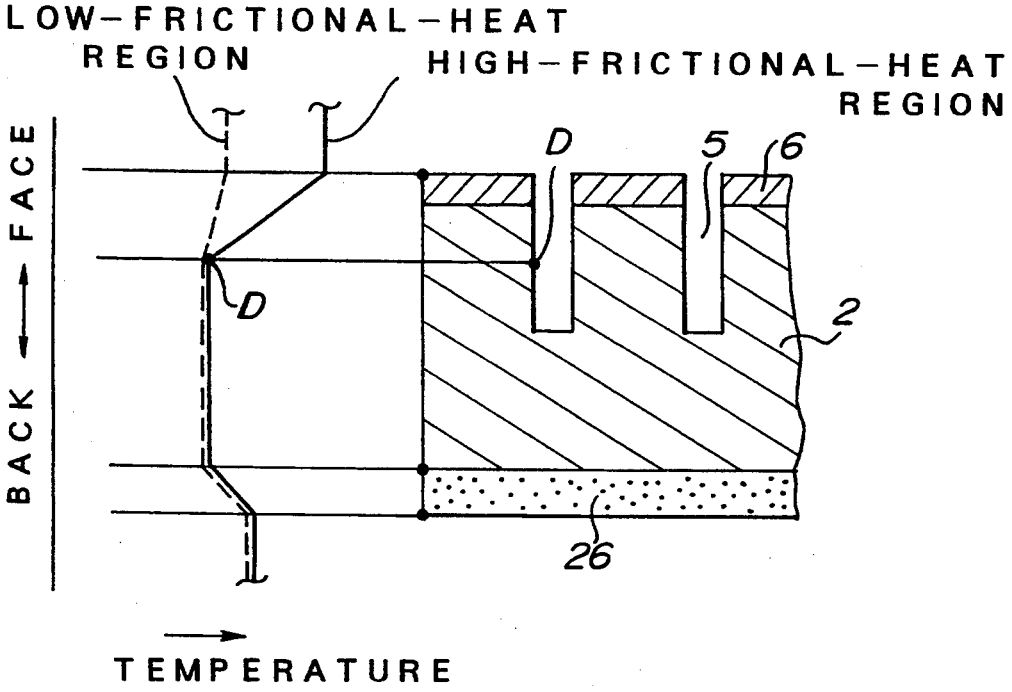
FIG. 4 is an enlarged fragmentary cross-sectional view of the reference table shown in FIG. 1 and a graph showing a temperature distribution across the reference table.

FIG. 4 shows a temperature distribution across the reference table 2 with the grooves 5 shown in FIG. 1. As shown in FIG. 4, the reference table 2 has different temperature regions, i.e., a high-frictional-heat region which is subjected to a high frictional heat due to abrasive contact with the semiconductor wafer 7 and a low-frictional-heat region which is subjected to a low frictional heat near the circumferential edge of the reference table 2. As indicated by the solid-line curve in FIG. 4, the temperature of the high-frictional-heat region drops with a sharp temperature gradient from the surface of the reference table 2 toward a midpoint D in each of the grooves 5, and is maintained at a low level downwardly below the midpoint D, which level is substantially the same as the temperature of the low-frictional-heat region as indicated by the dotted-line curve. Specifically, the abrasive compound 9 flowing through the grooves 5 is effective to reduce temperature differences in the reference table 2 while small higher-temperature regions remain near the surface of the reference table 2.

Figure 5:
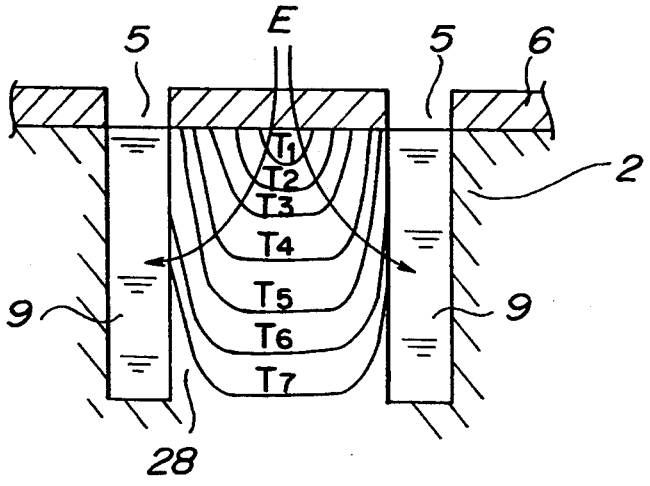
FIG. 5 is an enlarged fragmentary cross-sectional veiw of the reference table shown in FIG. 1, illustrative of a temperature distribution in a fin of the reference table.

FIG. 5 shows the manner in which a fin 28 between two adjacent grooves 5 is cooled by the abrasive compound 9 flowing through the grooves 5. Since the fin 28 is contacted by the abrasive compound 9 flowing through the grooves 5, the fin 28 is cooled by the abrasive compound 9. At this time, the temperatures in the fin 28 are represented by isothermal lines $T_1$, $T_2$, $T_3$, $T_4$, $T_5$, $T_6$, $T_7$ as shown in FIG. 5. The fin 28 has a higher temperature toward the surface of the reference table 2 ($T_1>T_2>T_3>T_4>T_5>T_6>T_7$). Because of the temperature distribution indicated by the isothermal lines $T_1$, $T_2$, $T_3$, $T_4$, $T_5$, $T_6$, $T_7$, therefore, the heat from the abrasive cloth 6 flows from the surface of the reference table 2 toward the grooves 5 as indicated by the arrows E, thereby cooling the fin 28. The heat that has been transferred into the grooves 5 is then carried by the abrasive compound 9, and dissipated through the abrasive compound receiver 11 (see FIG. 1) into the abrasive compound tank 13. The abrasive compound 9 thus returned to the abrasive compound tank 13 is then cooled by the coolant, and supplied again through the abrasive compound supply pipe 20 to the abrasive compound supply nozzle 10, as described above.

Figure 6:
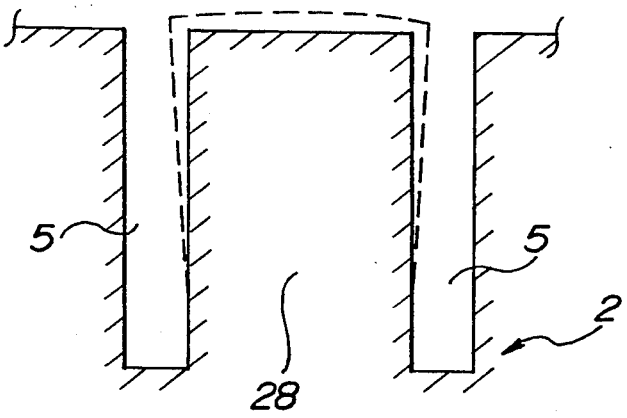
FIG. 6 is an enlarged fragmentary cross-sectional view showing the manner in which a fin of the reference table shown in FIG. 1 is deformed.
Figure 7:
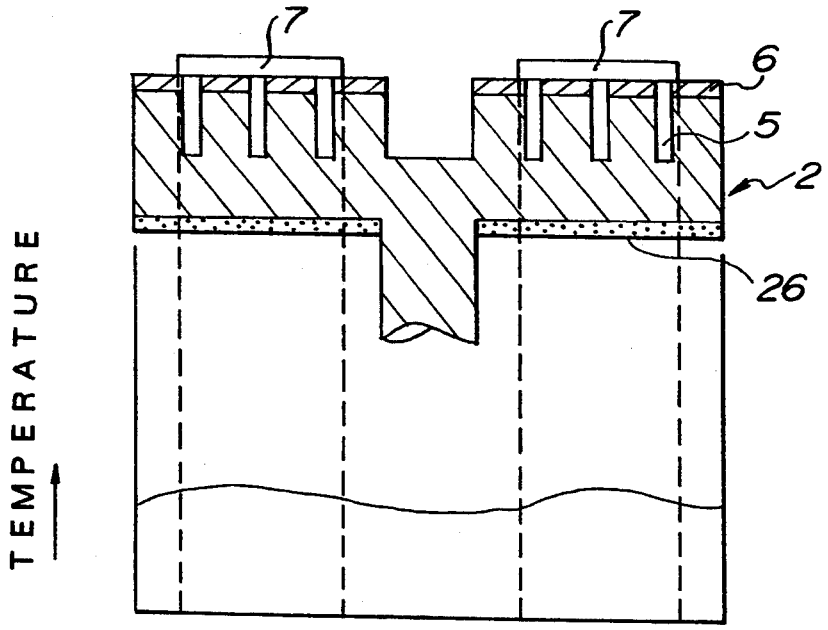
FIG. 7 is an axial cross-sectional view and a graph showing the degree of flatness of an abrasive cloth on the reference table shown in FIG. 1.

As shown in FIG. 6, the fin 28 is locally deformed near its upper outer surface as indicated by the dotted line. However, such a local deformation of the fin 28 is very small because it is cooled in the manner described above with reference to FIG. 5. Any thermally induced deformation of the lower portion of the reference table 2 on which the fins 28 are positioned is minimized as the heat is dissipated into the grooves 5. Accordingly, the surface of the reference table 2 which is held in contact with the semiconductor wafer 7 through the abrasive cloth 6 is kept substantially flat. As shown FIG. 7, any temperature differences in the abrasive cloth 6 that is held in direct contact with the semiconductor wafer 7 are very small, and abrasive cloth 6 is maintained substantially flat.

As shown in FIG. 1, the lower surface of the reference table 2 is covered with the thermally insulating 26 substantially in its entirety. The heat generated by the motor 22 and the transmission mechanism **25*a* is radiated upwardly toward the reference table 2. However, the thermally insulating layer 26 is effective in preventing the heat from being transmitted to the reference table 2. Accordingly, the reference table 2 is prevented from suffering temperature irregularities which would otherwise be caused by the heat from the motor 22 and the transmission mechanism 25*a***.

Since the reference table 2 and the abrasive cloth 6 are effectively cooled or prevented from being unduly heated, the polishing machine 1 can polish the semiconductor wafer 7 under high pressure at high speed for greater productivity.

Figure 8:
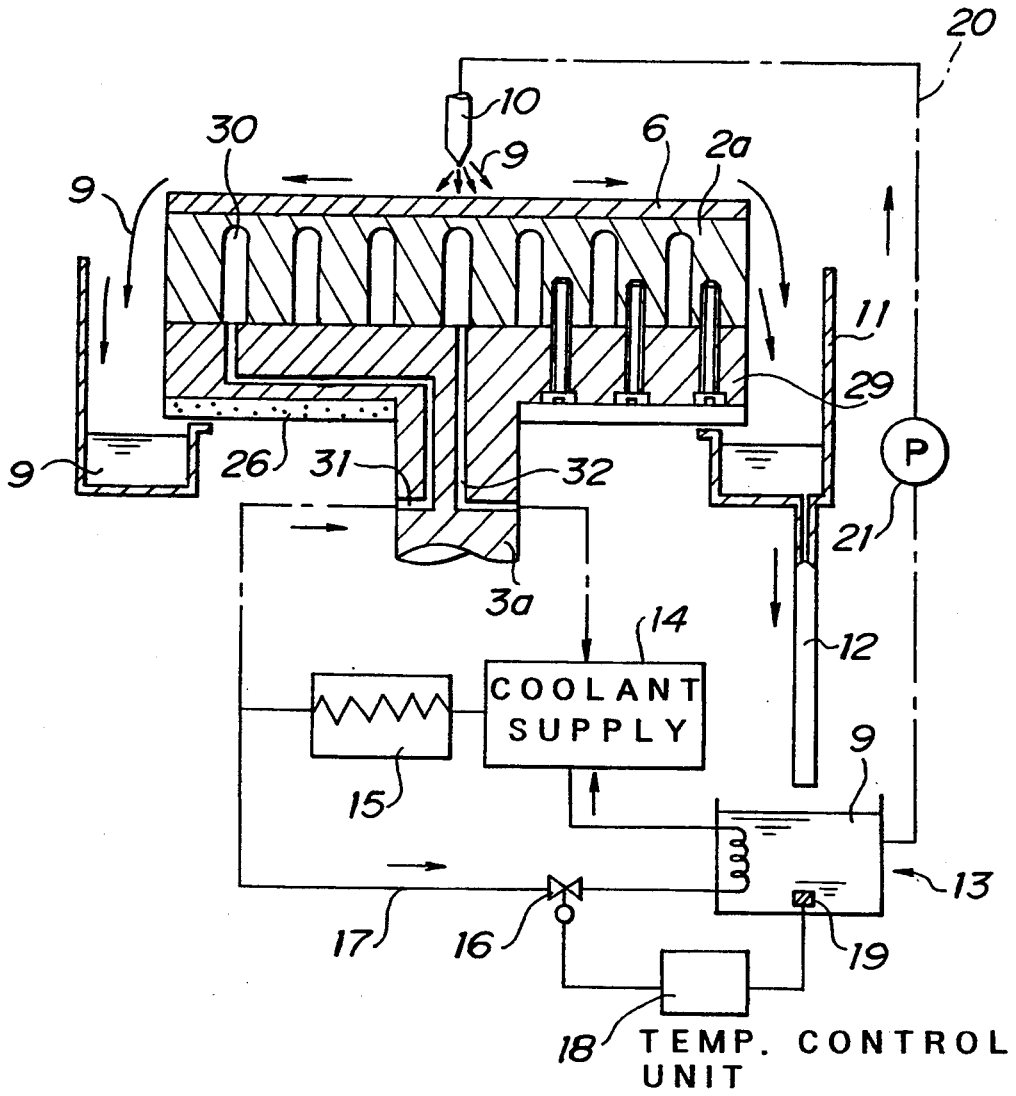
FIG. 8 is an axial cross-sectional view, partly in a coolant circuit diagram, of a polishing machine according to another embodiment of the present invention.

FIG. 8 shows a polishing machine according to another embodiment of the present invention. Those parts shown in FIG. 8 which are identical to those shown in FIG. 1 are denoted by identical reference characters, and will not be described in detail below.

In FIG. 8, the abrasive cloth 6 is disposed on a flat upper surface of a reference table **2*a* which is fixedly mounted on a reference table holder 29. The reference table holder 29 has an integral central shaft 3*a*** that is operatively coupled to a drive unit (not shown).

Figure 9:
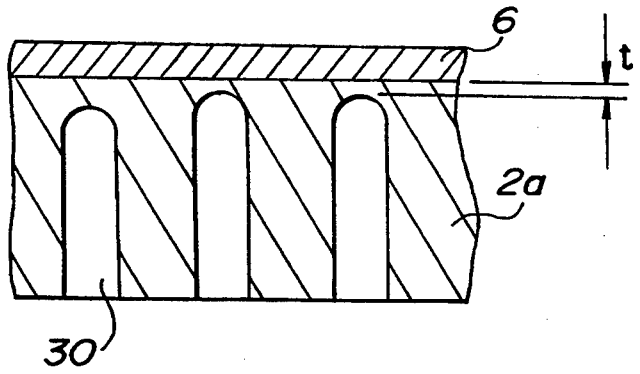
FIG. 9 is an enlarged fragmentary cross-sectional view of a reference table of the polishing machine shown in FIG. 8, the reference table having grooves.

The reference table **2*a* has a plurality of grooves 30 defined in its back held in contact with the reference table holder 29. The grooves 30, which are defined substantially entirely in the back of the reference table 2*a*, extend upwardly but terminate short of the upper surface of the reference table 2*a*. As shown in FIG. 9, the upper ends or bottoms of the grooves 30 are spaced from the upper surface of the reference table 2*a* by a distance or thickness t which is selected to be as small as possible. Since the thickness t is small, the reference table 2*a* is of small rigidity and can absorb deformations when the reference table 2*a* is thermally expanded. Therefore, the reference table 2*a* is prevented from being thermally deformed as a whole. The reference table holder 29 which is fixed to the reference table 2*a*** is of such high rigidity that the assembly of the reference table 2a and the reference table holder 29 is rigid enough to withstand mechanical stresses.

As shown in FIG. 8, the reference table holder 29 and the shaft 3a jointly have a coolant supply passage 31 and a coolant discharge passage 32. The coolant supply passage 31 has one end connected to the grooves 30 and the other end to the coolant supply 14 through the cooler 15. The coolant discharge passage 32 has one end connected to the grooves 30 and the other end to the coolant supply 14. The coolant from the coolant supply 14 flows into the cooler 15 which cools the coolant to a suitable temperature. The cooled coolant is then supplied through the coolant supply passage 31 into the grooves 30 to cool the reference table 2a in its entirety for reducing thermally induced deformations thereof.

The coolant in the grooves 30 that has absorbed the heat from the abrasive cloth 6 is discharged from the grooves 30 through the coolant discharge passage 32 to the coolant supply 14. The abrasive compound 9 from the abrasive compound tank 13 is supplied onto the abrasive cloth 6. The supplied abrasive compound 9 serves to polish the semiconductor wafer and also to cool the abrasive cloth 6 and the reference table 2a. The abrasive cloth 6 is kept flatwise to polish the semiconductor wafer to a desired degree of flatness.

Figure 10:
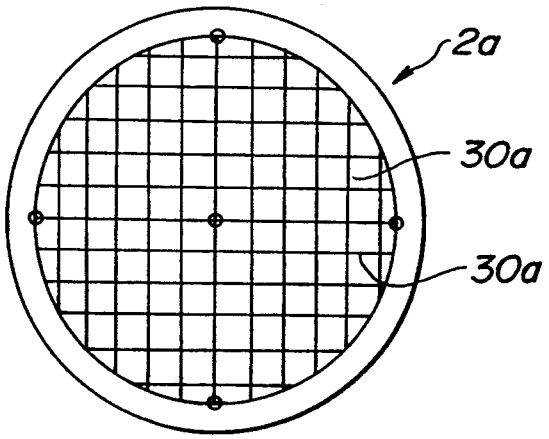
FIG. 10 is a plan view of the reference table shown in FIG. 8.

FIG. 10 shows in plan a grid pattern, i.e., a pattern of parallel rows and columns, of grooves 30a defined in the reference table 2a.

Figure 11:
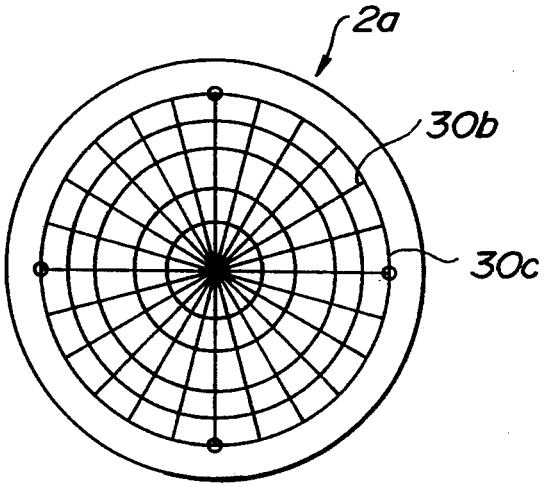
FIG. 11 is a plan view of a modified reference table that can be used in the polishing machine shown in FIG. 8, the modified reference table having grooves.

FIG. 11 shown in plan a pattern of radial grooves 30b and concentric grooves 30c which may be defined in the reference table 2a.

The reference table 2a may of course have any of various other different patterns of grooves.

Figure 12:
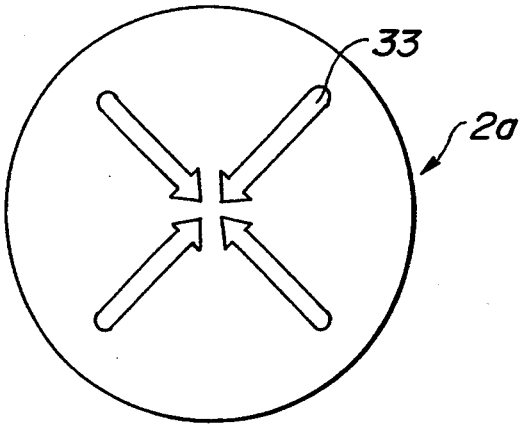
FIG. 12 through 14 are schematic plan views of other reference tables with grooves defining different coolant path patterns.
Figure 13:
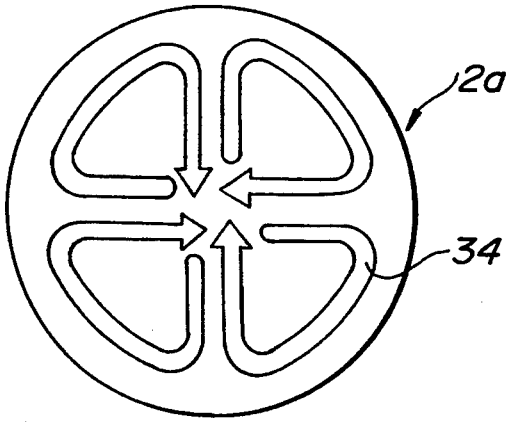
Figure 14:
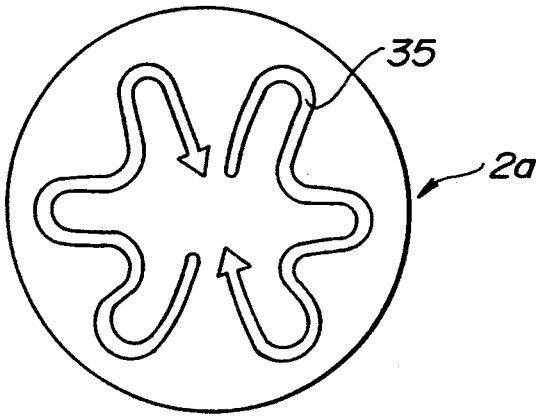

FIGS. 12 through 14 illustrate other reference tables with grooves defining different coolant path patterns. In FIGS. 12 through 14, the grooves 30a, 30b, 30c shown in FIGS. 10 and 11 are partly blocked to control flows of the coolant for uniformly and efficiently cooling the reference table 2a.

In FIG. 12, the reference table 2a has radial straight coolant passages 33 directed radially inwardly from the outer circumferential edge of the reference table 2a toward the center thereof for intensifying the coolant flows.

In FIG. 13, the reference table 2a is divided into quarter areas each having a curved coolant passage 34.

In FIG. 14, the reference table 2a is divided into half area each having a meandering coolant passage for smoothly and uniformly polishing the coolant substantially entirely through the reference table 2a.

Figure 15:
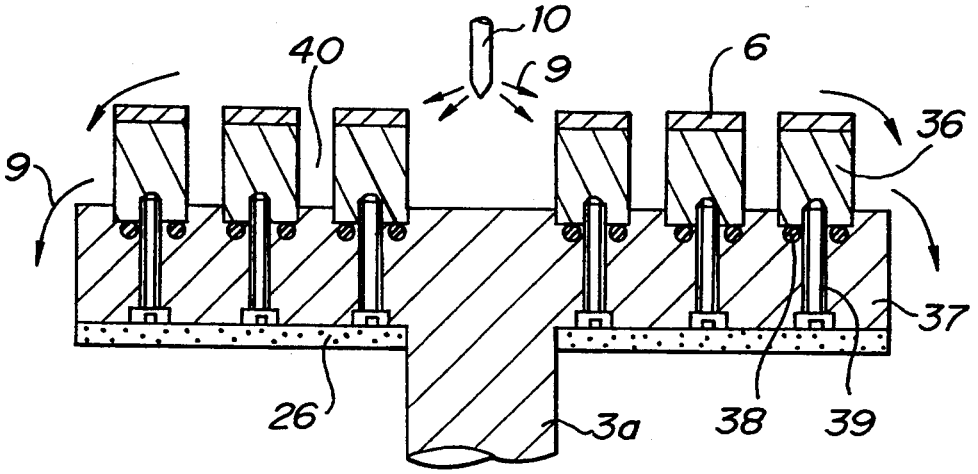
FIG. 15 is an axial cross-sectional view of reference table blocks of a polishing machine according to still another embodiment of the present invention.

In FIG. 15 shows a polishing machine according to still another embodiment of the present invention. The polishing machine shown in FIG. 15 has a plurality of reference table blocks 36 mounted on an upper surface of a reference table holder 37 through seals 38 by means of bolts 39. The reference table blocks 36 are positioned at spaced intervals with grooves 40 defined therebetween. The abrasive compound 9 ejected from the abrasive compound supply nozzle 10 is supplied onto the abrasive cloth 6 on the reference table blocks 36 and also flows through the grooves 40 to cool the reference table blocks 36 for thereby preventing the abrasive cloth 6 from being unduly heated and keeping the abrasive cloth 6 flatwise.

Figure 16:
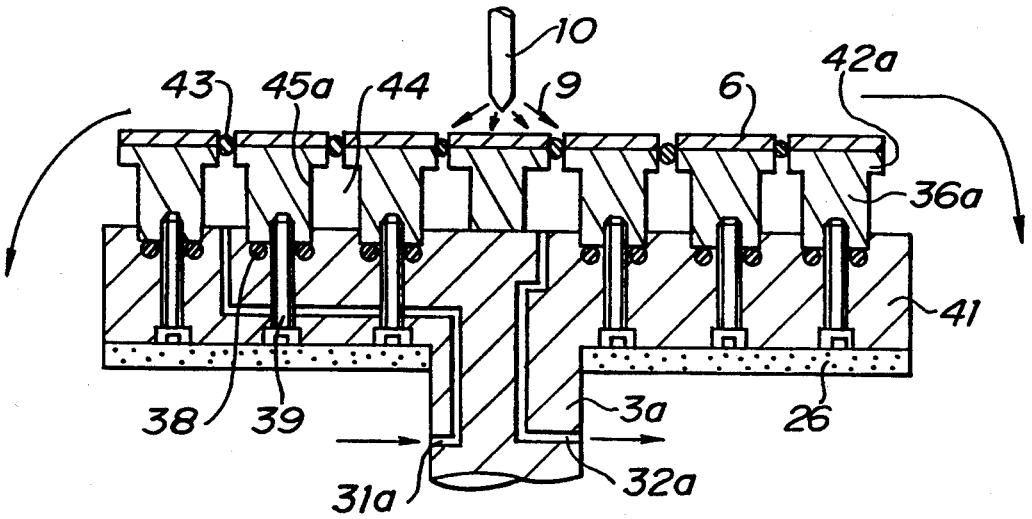
FIG. 16 is an axial cross-sectional view of reference table blocks of a polishing machine according to a further embodiment of the present invention.

FIG. 16 shows a polishing machine according to a further embodiment of the present invention. The polishing machine shown in FIG. 16 has a plurality of reference table blocks 36a mounted on an upper surface of a reference table holder 41 through seals 38 by means of bolts 39. Each of the reference table blocks 36a has a larger upper portion or a flange 42a on which the abrasive cloth 6 is disposed, and a smaller lower portion 45a extending downwardly from the flange 42a. The smaller lower portions 45a are fastened to the reference table holder 41 by the bolts 39. The reference table holder 41 and its integral shaft 3a jointly have a coolant supply passage 31a and a coolant discharge passage 32a. A seal 43 is snugly fitted between the flanges 42 of two adjacent reference table blocks 36a, thereby defining closed grooves 44 between the smaller lower portions 45a of the adjacent reference table blocks 36a. The coolant supply passage 31a and the coolant discharge passage 32a are held in communication with the grooves 44. Also in the polishing machine shown in FIG. 16, the abrasive compound 9 ejected from the abrasive compound supply nozzle 10 is supplied onto the abrasive cloth 6 on the reference table blocks 36a and also flows through the grooves 44 to cool the reference table blocks 36a for thereby preventing the abrasive cloth 6 from being unduly heated and keeping the abrasive cloth 6 flatwise.

FIGS. 17 through 20 illustrate other reference table blocks.

Figure 17:
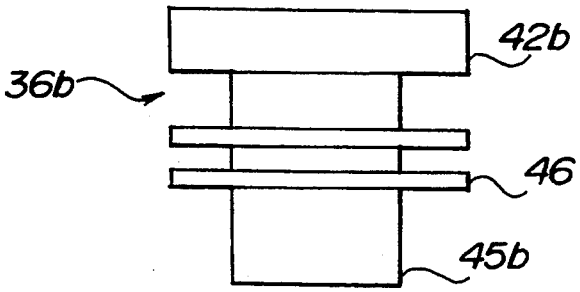
FIG. 17 through 20 are front elevational views of other reference table blocks.

In FIG. 17, a reference table block 36b comprises an upper flange 42b, a smaller lower portion 45b extending downwardly from the upper flange 42b, and fins 46 intergrally formed with the smaller portion 45b. The fins 46 provide a large area of contact with the coolant for effectively cooling the reference table block 36b.

Figure 18:
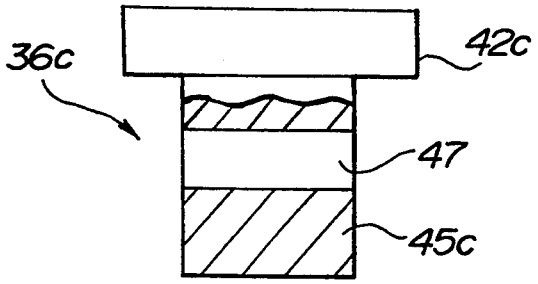

In FIG. 18, a reference table block 36c comprises an upper flange 42c and a smaller lower portion 45c extending downwardly from the upper flange 42c and having a horizontal through hole 47 defined therethrough. The horizontal through hole 47 allows the coolant to flow therethrough for cooling the reference table block 36c more effectively.

Figure 19:
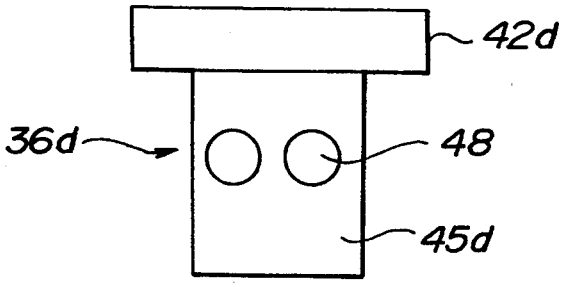

In FIG. 19, a reference table block 36d comprises an upper flange 42d and a smaller lower portion 45d extending downwardly from the upper flange 42d and having two horizontal through holes 48 defined therethrough. The horizontal through holes 48 allow the reference table block 36d to be cooled much more effectively with the coolant flowing therethrough.

Figure 20:
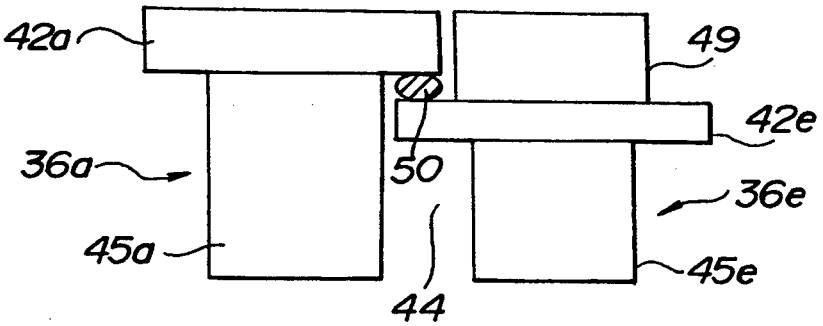

In FIG. 20, each reference table block 36a shown in FIG. 16 is combined with a reference table block 36e positioned adjacent thereto. The reference table block 36e comprises a larger upper portion 49, an intermediate flange 42e positioned beneath the larger upper portion 49, and a smaller lower portion 45e extending downwardly from the intermediate flange 42e. The flange 42a of the reference table block 36a and the intermediage flange 42e of the reference table block 36e vertically overlap each other with a seal 50 sandwiched therebetween. The smaller lower portions 45a, 45e of the adjacent reference table blocks 36a, 36e jointly define a groove 44 therebetween.

Figure 21:
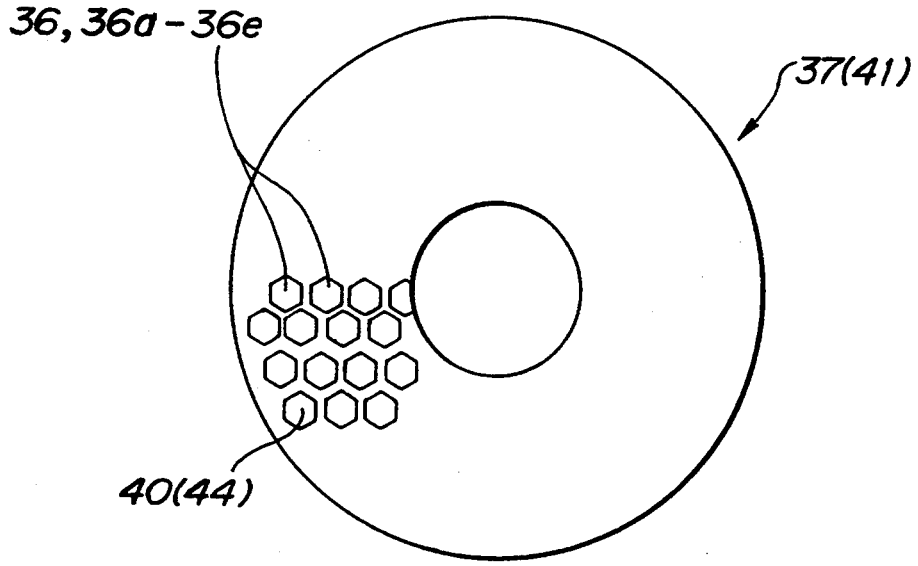
FIG. 21 is a plan view of a pattern in which the reference table blocks shown in FIGS. 15 and 16 are arranged.

FIG. 21 shows a pattern in which the reference table blocks 36, 36a, 36b, 36c, 36d, 36e may be arranged on the reference table holder 37 or 41. As shown in FIG. 21, each of the reference table blocks 36, 36a, 36b, 36c, 36d, 36e has a hexagonal shape as viewed from above, with the grooves 40 or 44 being defined between these reference table blocks.

Figure 22:
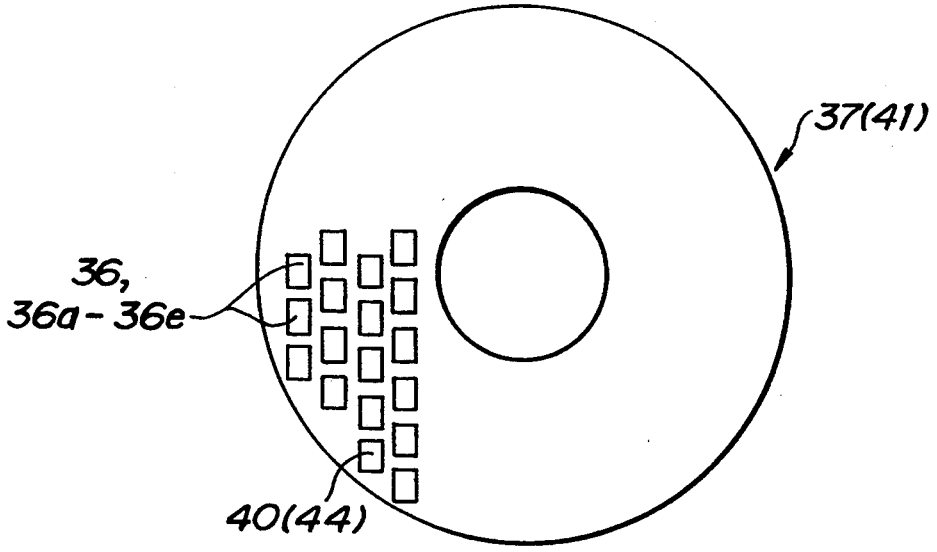
FIG. 22 is a plan view of another pattern in which the reference table blocks shown in FIGS. 15 and 16 are arranged.

FIG. 22 shows another pattern in which the reference table blocks 36, 36a, 36b, 36c, 36d, 36e may be arranged on the reference table holder 37 or 41. As shown in FIG. 22, each of the reference table blocks 36, 36*a*, 36*b*, 36*c*, 36*d*, 36*e* has a rectangular shape as viewed from above, with the grooves 40 or 44 being defined between these reference table blocks.

The reference table blocks may be shaped and sized depending on the temperature distribution in the reference table 2 and the abrasive cloth 6 for cooling them effectively with the coolant flowing through the grooves 40 or 44.

Figure 23:
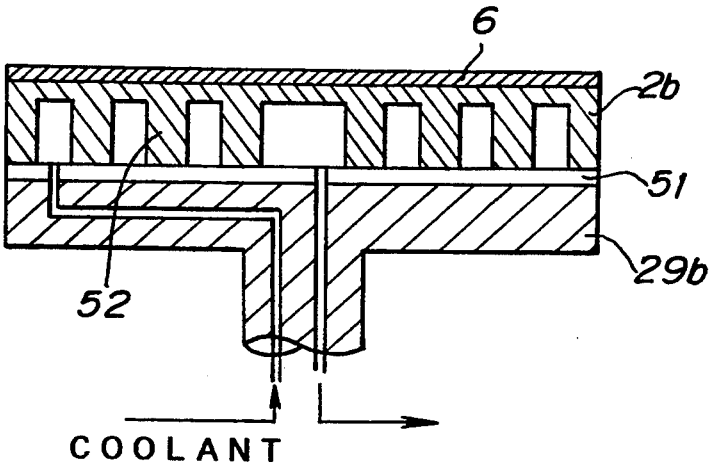
FIG. 23 is an axial cross-sectional view showing a reference table, a reference table holder, and a thermally insulating layer interposed therebetween.
Figure 24:
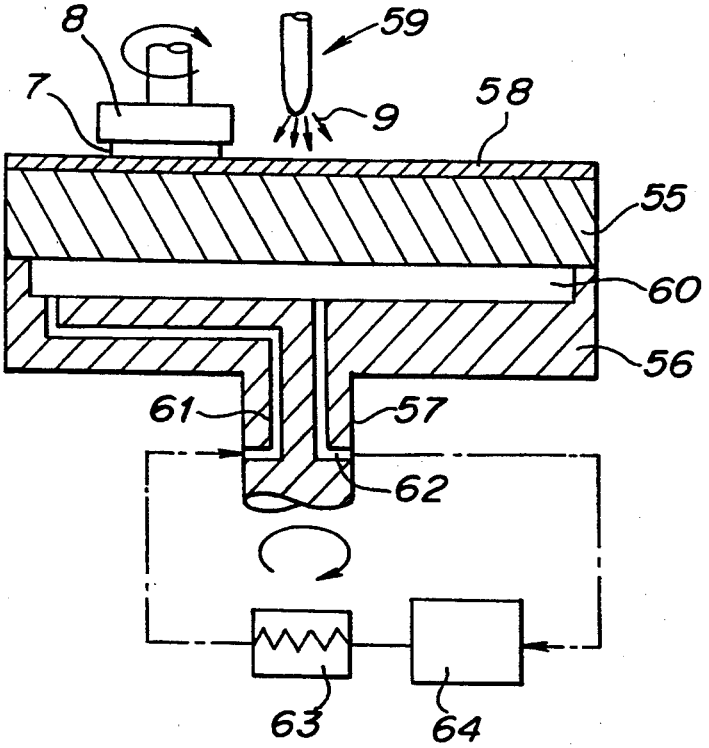
FIG. 24 PRIOR ART
FIG. 24 is an axial cross-sectional view, partly shown in a coolant circuit diagram, of a conventional polishing machine.
Figure 25:
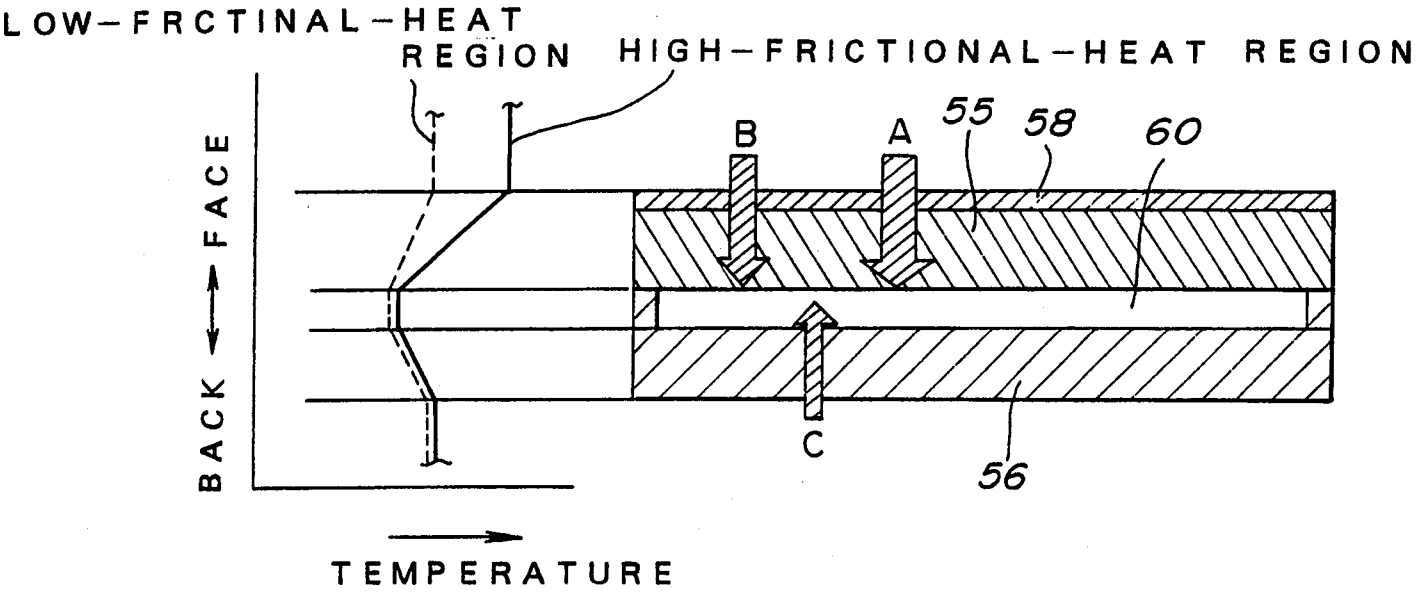
FIG. 25 PRIOR ART
FIG. 25 is an enlarged cross-sectional view of a reference table of the conventional polishing machine shown in FIG. 24 and a graph showing a temperature distribution across the reference table.
Figure 26:
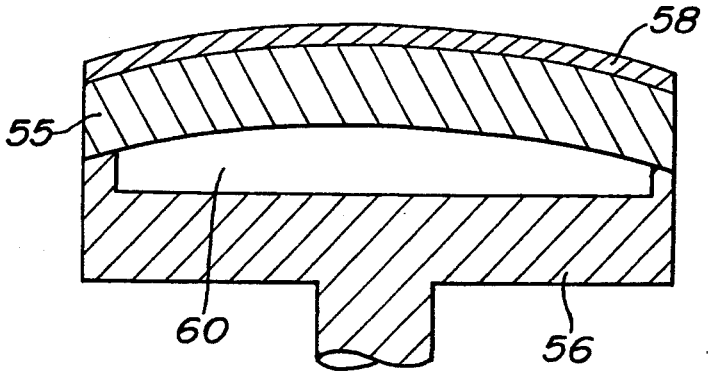
FIG. 26 is an axial cross-sectional view showing the manner in which the reference table shown in FIG. 25 is deformed due to heat.
Figure 27:
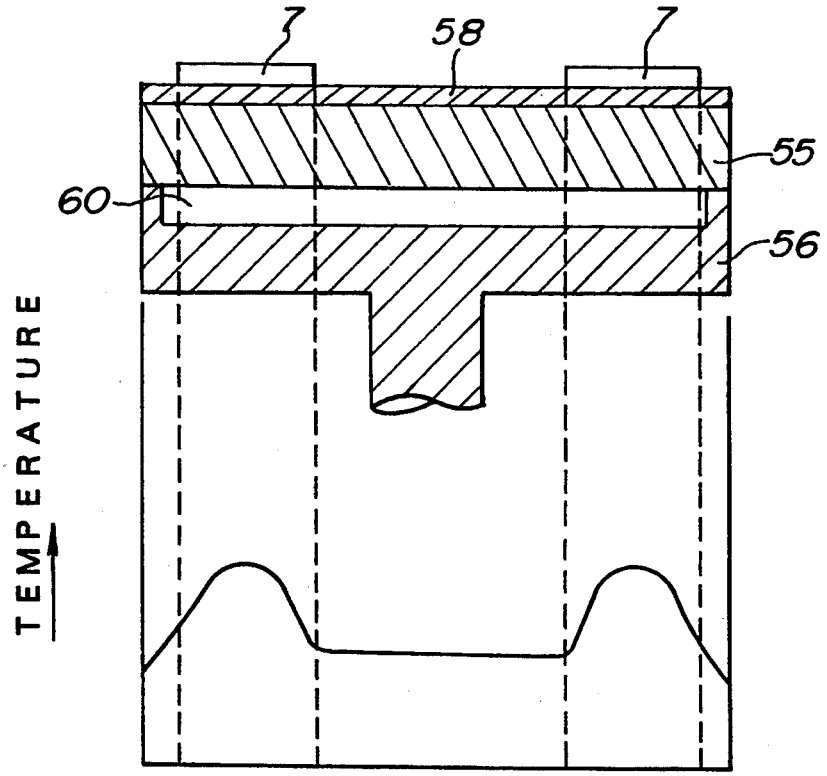
FIG. 27 is an enlarged cross-sectional view of the reference table shown in FIG. 24 and a graph showing an abrasive load distribution in semiconductor wafers.
Figure 28:
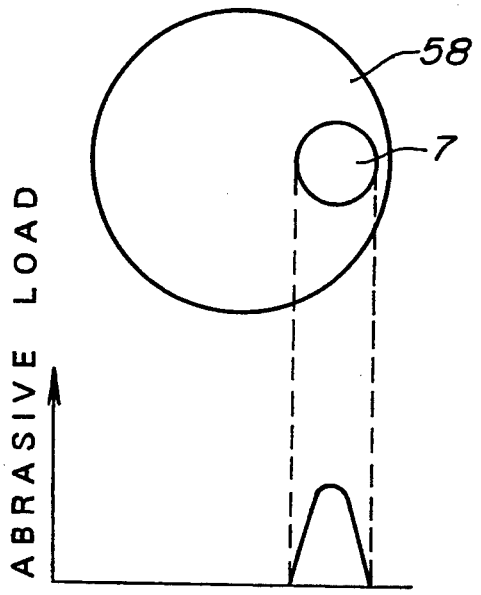
FIG. 28 is a plan view and a graph illustrative of an abrasive load distribution in a single semiconductor wafer that is polished by the conventional polishing machine.
Figure 29:
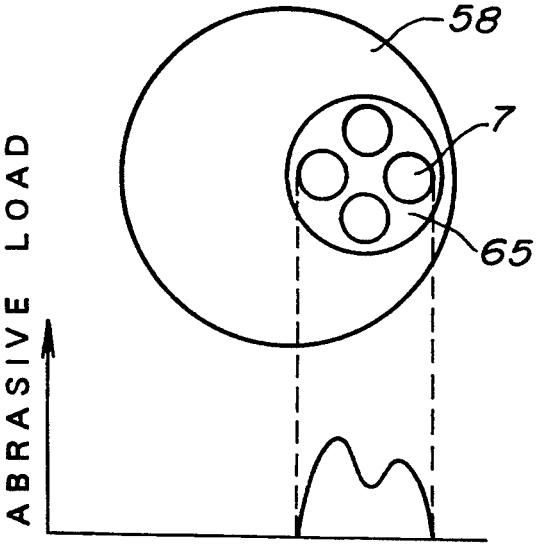
FIG. 29 is a plan view and a graph illustrative of an abrasive load distribution in a batch of semiconductor wafers that are simultaneously polished by the conventional polishing machine.

FIG. 23 illustrates a reference table 2*b*, a reference table holder 29*b*, and a thermally insulating layer 51 interposed therebetween. In FIG. 23, the reference table 2*b* supports the abrasive cloth 6 on its upper surface and has a coolant reservoir 5 defined in its lower surface in the form of grooves. The reference table holder 29*b* has coolant supply and discharge passages defined therein which are held in communication with the coolant reservoir 5. The thermally insulating layer 51 serves to prevent heat from being transferred from the reference table holder 29*b* to the reference table 2*b*. The thermal capacity of the reference table 2*b* is therefore lowered to shorten the period of time that is required for the reference table 2*b* to reach its steady condition when the polishing machine starts to operate.

Two of the reference table with the abrasive cloth in each of the above embodiments may be employed to sandwich a semiconductor wafer for simultaneously polishing the opposite surfaces thereof to a flat finish.

While only one semiconductor wafer is shown as being polished by the polishing machine according to each of the above embodiments, the principles of the present invention are also applicable to a polishing machine for simultaneously polishing a batch of semiconductor wafers.

Although certain preferred embodiments of the present invention have been shown and described in detail, it should be understood that various changes and modifications may be made therein without departing from the scope of the appended claims.

What is claimed is:

1. A polishing machine for polishing a flat workpiece, comprising:

a plurality of reference table blocks each supporting an abrasive cloth disposed on a surface thereof;

a rotatable workpiece holder for holding a flat workpiece against said abrasive cloth; and means for supplying an abrasive compound between said abrasive cloth and the flat workpiece; wherein said reference table blocks define a plurality of grooves therebetween for dissipating heat from said reference table blocks and said abrasive cloth while the flat workpiece is being polished by said abrasive cloth, and wherein said reference table blocks have respective flanges interconnected through seals.

2. A polishing machine according to claim 1, wherein said reference table blocks are spaced from each other.

3. A polishing machine according to claim 1, wherein each of said reference table blocks comprises a flange and a smaller portion extending therefrom.

4. A polishing machine according to claim 3, wherein said smaller portion supports at least one fin thereon.

5. A polishing machine according to claim 1, wherein each of said reference table blocks has a rectangular shape.

6. A polishing machine according to claim 1, further comprising a reference table holder, said reference table blocks being mounted on said reference table holder, and a thermally insulating layer disposed on a surface of said reference table holder remote from said reference table blocks.

7. A polishing machine according to claim 1, wherein said plurality of grooves are arranged in criss-cross relationship.

8. A polishing machine according to claim 3, wherein said plurality of grooves are arranged in criss-cross relationship.

9. A polishing machine according to claim 4, wherein said plurality of grooves are arranged in criss-cross relationship.

10. A polishing machine according to claim 6, wherein said plurality of groves are arranged in criss-cross relationship.

11. A polishing machine according to claim 1, wherein said reference table blocks are spaced from each other.

12. A polishing machine according to claim 1, wherein said each of said reference table blocks has a hexagonal shape.

13. A polishing machine according to claim 1, wherein said each of said reference table blocks has a rectangular shape.

14. A polishing machine according to claim 6, wherein said reference table blocks are spaced from each other.

15. A polishing machine according to claim 6, wherein said each of said reference table blocks has a hexagonal shape.

16. A polishing machine according to claim 6, wherein said each of said reference table blocks has a rectangular shape.

17. A polishing machine for polishing a flat workpiece, comprising:

a plurality of reference table blocks each supporting an abrasive cloth disposed on a surface thereof;

a rotatable workpiece holder for holding a flat workpiece against said abrasive cloth;

a means for supplying an abrasive compound between said abrasive cloth and the flat workpiece; and a reference table holder, said reference table blocks being mounted on said reference table holder, and a thermally insulating layer disposed on a surface of said reference table holder remote from said reference table blocks; wherein said reference table blocks define a plurality of grooves therebetween for dissipating heat from said reference table blocks and said abrasive cloth while the flat workpiece is being polished by said abrasive cloth.

18. A polishing machine according to claim 17, wherein said plurality of groves are arranged in criss-cross relationship.

19. A polishing machine according to claim 17, wherein said reference table blocks are spaced from each other.

20. A polishing machine according to claim 17, wherein said each of said reference table blocks has a hexagonal shape.

21. A polishing machine according to claim 17, wherein said each of said reference table blocks has a rectangular shape.

22. A polishing machine for polishing a flat workpiece, comprising:

a plurality of reference table blocks each supporting an abrasive cloth disposed on a surface thereof;

a rotatable workpiece holder for holding a flat workpiece against said abrasive cloth;

a means for supplying an abrasive compound between said abrasive cloth and the flat workpiece; wherein said reference table blocks define a plurality of grooves therebetween for dissipating heat from said reference table blocks and said abrasive cloth while the flat workpiece is being polished by said abrasive cloth; wherein each of said reference table blocks comprises a flange and a smaller portion extending therefrom, and wherein said smaller portion supports at least one fin thereon.

23. A polishing machine according to claim 22, wherein said plurality of groves are arranged in criss-cross relationship.

* * * * *